United States Patent [19]

Mrotz, III et al.

[11] Patent Number: 4,796,950

[45] Date of Patent: Jan. 10, 1989

[54] TILT MECHANISM, PARTICULARLY FOR KNEE-TILT CHAIR

[75] Inventors: Walter C. Mrotz, III, North Muskegon; Donald L. Cool, Holland; Fred C. Liebertz, Twin Lake, all of Mich.

[73] Assignee: Haworth, Inc., Holland, Mich.

[21] Appl. No.: 12,573

[22] Filed: Feb. 9, 1987

[51] Int. Cl.[4] ..... A47C 3/00

[52] U.S. Cl. ..... 297/302; 297/304; 248/608

[58] Field of Search ..... 297/302, 303, 304, 305, 297/306, 300, 301; 248/608, 609

[56] References Cited

U.S. PATENT DOCUMENTS

| | | | |
|---|---|---|---|
| 581,762 | 5/1897 | Neuens . | |
| 1,747,932 | 2/1930 | Dufaux . | |
| 2,095,947 | 10/1937 | Herold | 248/609 |
| 2,362,746 | 11/1944 | De Vries . | |
| 2,365,200 | 12/1944 | Lorenz . | |
| 2,606,592 | 8/1952 | McIntyre | 297/303 X |
| 2,619,153 | 11/1952 | Van Osselen | 297/302 |
| 2,633,897 | 4/1953 | Moore . | |
| 2,840,140 | 6/1958 | Harrington | 297/303 X |
| 3,493,211 | 2/1970 | Barecki et al. | 248/608 X |
| 3,504,881 | 4/1970 | Pillons et al. | 248/609 |
| 3,627,252 | 12/1971 | Yamaguchi . | |
| 3,659,819 | 5/1972 | Wolters . | |
| 3,740,792 | 6/1973 | Werner . | |
| 3,881,772 | 5/1975 | Mohrman | 248/609 |
| 4,235,408 | 11/1980 | Sapper | 297/306 |
| 4,384,741 | 5/1983 | Flum et al. . | |
| 4,529,247 | 7/1985 | Stumpf et al. . | |
| 4,575,151 | 3/1986 | Edstrom . | |
| 4,652,050 | 3/1987 | Stevens . | |
| 4,653,806 | 3/1987 | Willi . | |
| 4,666,121 | 5/1987 | Choong et al. . | |

FOREIGN PATENT DOCUMENTS

| | | | |
|---|---|---|---|
| 490970 | 3/1953 | Canada . | |
| 933492 | 9/1955 | Fed. Rep. of Germany . | |
| 1554058 | 3/1970 | Fed. Rep. of Germany . | |
| 656782 | 5/1929 | France . | |
| 656957 | 9/1951 | United Kingdom | 297/302 |
| 785194 | 10/1957 | United Kingdom . | |

OTHER PUBLICATIONS

Herman Miller Brochure: "Equa A Chair For People Who Can't Sit Still" 1984 16 pages.

Herman Miller Brochure: "Equa Seating", 1985, 15 pages.

Herman Miller Brochure: "We Hope You Enjoy Your New Equa Chair", 1984, 1 page.

Herman Miller Magazine, "From Equa Seating to Seafood Linguini", pages 31-36.

*Primary Examiner*—Francis K. Zugel

*Attorney, Agent, or Firm*—Flynn, Thiel Boutell & Tanis

[57] ABSTRACT

The seat and pedestal of a chair are joined by a knee-tilt mechanism which includes a first support fixed to the underside of the seat adjacent the front edge thereof, and a second support fixed to the pedestal and having a sidewardly extending support tube arrangement. The first support has bearing hubs rotatably engaged with the support tube to define a horizontal tilt axis. A restoring mechanism is disposed within the second support for exerting a restoring torque about the tilt axis for urging the seat toward its horizontal position. The restoring mechanism, in the preferred embodiment, employs a sleevelike spring member of an elastomeric material disposed on the tilt axis for developing a restoring torque which generally linearly increases as the seat tilts away from the horizontal position. A second spring coacts between the supports for generating a second restoring torque which is additive with the first torque to effectively cause a torque dwell to facilitate tilting beyond an intermediate position.

18 Claims, 5 Drawing Sheets

TILT MECHANISM, PARTICULARLY FOR KNEE-TILT CHAIR

FIELD OF THE INVENTION

This invention relates to an improved knee-type tilt mechanism for a chair.

BACKGROUND OF THE INVENTION

Pedestal-type office chairs have conventionally utilized a tilt-type control mechanism connecting the upper end of the pedestal to the chair seat. This control mechanism defines a substantially horizontal tilt axis which extends sidewardly across the chair directly adjacent the underside thereof, with the tilt axis being disposed substantially directly over the pedestal and hence disposed substantially midway between the front and rear edges of the chair seat. With this mechanism, rearward tilting of the chair seat results in the rear edge of the seat swinging downwardly, and simultaneously the front edge of the chair seat lifts upwardly causing undesired lifting of the occupant's legs in the vicinity of the knees. Tilt control mechanism of this type have long possessed this recognized disadvantage, but have nevertheless been extensively utilized in view of the difficulties in resolving this problem.

In recent years chair manufacturers have succeeded in developing a knee-tilt control mechanism. This mechanism connects to the upper end of the pedestal but is positioned forwardly therefrom, whereby the sidewardly extending horizontal tilt axis is disclosed more closely adjacent the front edge of the chair seat. In this manner, rearward tilting of the seat structure is accomplished solely by a downward tilting of the rear edge of the seat, with the front edge of the seat experiencing only minimal elevational change. The occupant can thus experience tilting of the seat structure without encountering undesired lifting of the legs away from the floor.

The design of a proper knee-tilt mechanism has presented several formidable problems since such mechanism has to be cantilevered forwardly from the upper end of the pedestal, and at the same time the mechanism must be disposed within a package which does not ruin the appearance of the chair.

Most attempts to provide a knee-tilt mechanism have employed a spring-type restoring device using torsion or compression springs, the latter cooperating with levers or a linkage for continually urging the seat structure upwardly into its normal horizontal position when unoccupied. These spring-type restoring devices have, for the most part, created a restoring force which substantially linearly increases as the tilt angle increases, the latter typically being a minimum of about 15° downwardly from the horizontal or at rest position (i.e., the chair being unoccupied). Because of the substantially linear relationship of the restoring force, the known mechanism have possessed disadvantages which have made use of these mechanisms, and the use and comfort of the chairs employing them, less than desired.

For example, the known knee-tilt mechanisms have normally employed a substantially linear restoring spring arrangement which possesses a spring rate such that the restoring force increases significantly as the seat structure is tilted backwardly. This significant increase in the spring force is required so as to support the chair occupant and counterbalance the backward tilt. If a low initial torque and low spring rate are used, it has been observed that when the occupant initially sits in the chair, the weight of the occupant itself causes the seat structure to tilt backwardly through a substantial extent, such as up to about 10°. This has been observed to be an undesirable degree of tilt since it detracts from the chair comfort when working at a desk or table. A rearward tilt in the range of 3° to 5° is preferred under such circumstance.

To overcome this latter problem, several different structures have been tried. The primary attempt has involved the use of a mechanical lock which is manually controlled by the chair occupant. That is, the knee( tilt mechanism is maintained with a spring mechanism having properties of the type explained above, and in addition the mechanism is provided with a manually controlled mechanical lock. This lock is normally activated by the occupant and, in effect, results in the chair seat being fixed in its upright position, that is, the seat being oriented substantially horizontally. When tilting of the seat is desired, the occupant has to release the mechanical lock so that the tilt mechanism then permits rearward tilting of the chair seat. Needless to say, the provision of this mechanical lock greatly detracts from the comfort and flexibility of the chair since the occupant must basically always be converting the chair from a fixed to a tilt condition, or vice versa, and this manual manipulation obviously detracts from the desirability of the chair.

In other attempts to overcome this problem, other variations of the tilt mechanism have used a higher spring rate, and/or have increased the initial restoring force (i.e., the precompression or pretorque) of the spring which maintains the unoccupied seat structure in its horizontal position. Increasing the spring rate and/or initial restoring force thus tends to counteract the initial weight of the occupant. These changes, however, also cause the linear relationship of the restoring force to be increased or shifted upwardly throughout the complete tilt range so that, when a person attempts to tilt the chair seat backwardly throughout substantially its full range, it has been observed that many occupants are unable to exert (at least comfortably) sufficient force so as to permit rearward tilting of the chair throughout substantially the full tilt angle. Under this circumstance, the chair occupant again finds the chair highly uncomfortable due to the inability to comfortably tilt backwardly the full extent, and due to the excessively large restoring force which the occupant must overcome.

Another commercial chair has attempted to overcome the above problem by using a restoring mechanism which, while it employs a spring having a substantially linear restoring force, nevertheless the spring cooperates with a lever arm which, due to the angular relationships involved, is intended to modify the restoring torque and hence minimize the above-mentioned problem. Experience with this known mechanism, however, indicates that the modification of the restoring torque through use of this lever arm is so insignificant as to be practically non-noticeable, and the overall restoring mechanism still results in a restoring function which possesses the same disadvantages.

Accordingly, it is an object of this invention to provide an improved knee-tilt control mechanism which is believed to overcome many of the disadvantages which have been associated with prior structures as explained above. The knee-tilt control mechanism of this invention is particularly of the passive type in that it does not require any charge or action by the occupant, but rather permits automatic reclining when desired.

More specifically, it is an object of this invention to provide an improved knee-tilt control mechanism which provides a substantially nonlinear restoring torque throughout the angle of tilt so as to provide adequate stiffness to maintain the chair seat at a desired position under normal use conditions with an occupant therein, while at the same time permitting the chair to be tilted rearwardly throughout substantially its full range without generating an excessively large restoring torque which make tilting difficult or uncomfortable.

In a preferred embodiment of this improved kneetilt control, the nonlinear restoring torque preferably includes a substantially linearly increasing restoring torque over the initial range of tilt such as from the 0° position to about the 5° position, with the restoring torque thereafter undergoing a "dwell" or minimal change during further chair tilt so as to prevent the maximum restoring torque at the full tilt angle from reaching an excessive magnitude.

In the improved mechanism of this invention, as aforesaid, the initial restoring torque, and the increasing restoring torque as the chair seat tilts rearwardly due to the weight of the occupant, is such as to maintain the chair seat at only a small rearward tilt angle with respect to the horizontal, such as a maximum tilt angle of about 3° to 5°, to hence maintain an optimum seating position for the occupant. At the same time, rearward tilting of the seat throughout its full range can be easily accomplished, even by a person of rather light weight, without encountering excessive restoring torque which makes such tilting uncomfortable or impossible.

A further object is to provide an improved mechanism, as aforesaid, which is relatively compact and hence can be structurally and properly designed so as to be positioned directly under the front portion of the chair seat without detracting from the overall esthetics or appearance of the chair. This improved mechanism also possesses the capability of permitting the initial restoring torque to be selectively adjusted without requiring any complex adjustment function or disassembly of the mechanism.

According to one embodiment of the present invention, the seat structure and pedestal of a chair are joined together by a knee-tilt control mechanism which includes a first support which is fixed to and projects downwardly from the underside of the chair seat adjacent the front edge thereof, and a second support which is fixed to the upper end of the pedestal and projects forwardly therefrom so as to terminate in a generally sidewardly extending tubelike structure. The first support has a pair of bearing hubs at opposite ends which are rotatably engaged with the tubelike structure so as to define a horizontal tilt axis which extends sidewardly of the chair seat and is disposed closely adjacent the underside thereof in close proximity to the front edge. A spring-type restoring mechanism coacts between the first and second supports for exerting a restoring moment or torque which continuously urges the chair seat upwardly into a substantially horizontal (i.e., zero tilt) position. The restoring mechanism preferably includes a first spring unit, such as a torsion spring, which develops a restoring torque which increases substantially linearly as the tilt of the chair seat increases from the zero-tilt to the maximum tilt position. The pretorque of this first spring unit can be adjusted to select the restoring torque which is imposed on the chair at the zero tilt position. The restoring mechanism employs a second spring unit which cooperates in generally parallel relationship to the first spring unit and, while the second spring unit develops a restoring torque which also increases approximately linearly as the chair tilts away from the zero tilt position to an intermediate position of about 5°, the restoring torque generated by this mechanism throughout the remaining range of tilt thereafter deviates from the initial linearity so that the total restoring torque hence exhibits a "dwell" effect substantially at the intermediate location. To achieve this nonlinear torque relationship throughout its tilt range, the second spring unit employs a spring which cooperates with a cam profile, the latter in turn being associated with a swingable lever so that the force or compression in the spring increases only up to about the intermediate location, after which the compression force in the spring remains substantially constant or continues to increase but only at a significantly lower rate in relationship to the rate of tilt. In addition, due to the positional relationship between the cam and lever when the tilt exceeds the intermediate location, the compression force of the spring acts through a smaller lever arm such that the first spring unit exerts a reduced restoring torque as the tilt angle increases, thus minimizing the build-up in combined restoring torque as the tilt angle reaches its maximum.

According to another embodiment of the invention, the second spring unit again cooperates in generally parallel relationship to the first spring unit so that the restoring torque is the sum of the torques generated by the first and second spring units. The second spring unit, however, develops a restoring torque which is a maximum at the zero-tilt position, and this restoring torque remains fairly constant throughout the initial tilt up to about 4° or 5°, and thereafter progressively decreases throughout the full angle of tilt. The total restoring torque generated by the first and second spring units thus increases generally linearly from the zero-tilt position to an intermediate position of about 5°, with the total restoring torque continuing to increase throughout the full tilt angle but doing so at a continually decreasing rate so that the maximum restoring torque as developed when the chair seat reaches its full tilt angle is of a magnitude which does not interfere with the comfort and convenience of use of the chair.

Other objects and purposes of the invention will be apparent upon reading the following specification and inspecting the drawings.

Figure 1:
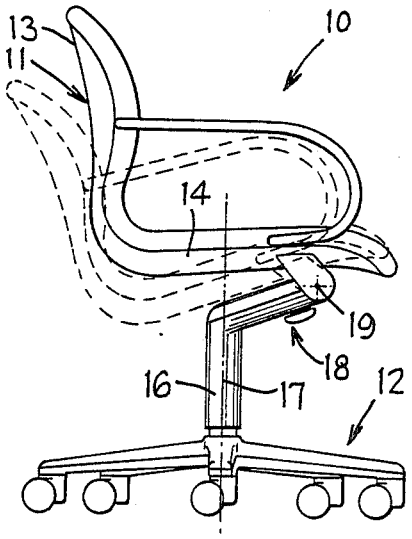
FIGS. 1 and 2 diagrammatically illustrate side and front elevational views, respectively, of a pedestal-type chair employing the improved knee-tilt control mechanism of invention.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the chair and designated parts thereof. Said terminology will include the words specifically mentioned, derivatives thereof, and words of similar import.

DETAILED DESCRIPTION

Figure 2:
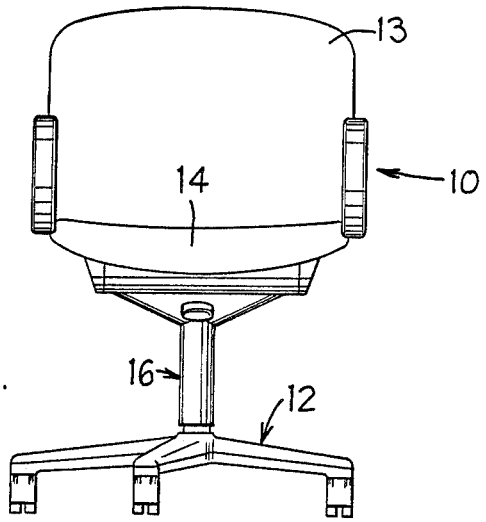

FIGS. 1 and 2 illustrate a pedestal-type chair 10 having a seat structure 11 supported on a pedestal-type base assembly 12. The seat structure 11 includes a back 13 integrally joined to a seat 14, although the seat and back could be separate as is conventional. The base assembly 12 includes a wheeled five-star base which is generally conventional and has a central pedestal 16 projecting vertically upwardly therefrom, which pedestal defines a vertical swivel axis 17 which intersects approximately at the center of the seat 14.

In the improved chair of the present invention, the pedestal 16 and seat 14 are joined together by a tilt or pivot mechanism 18 of the knee-joint type, which mechanism 18 defines a generally horizontally extending tilt axis 19 which extends transversely (i.e., sidewardly) of the seat 14 and is disposed in forwardly spaced relationship from the swivel axis 17 so as to be positioned more closely adjacent the front edge of the seat 14 while being disposed vertically directly thereunder.

The tilt mechanism 18 is spring biased so as to normally maintain the seat 14 in a substantially 0° tilt (i.e. zero tilt) position as illustrated by FIG. 1, in which position the seat 14 extends approximately horizontally from front-to-back. Under load, however, such as created by an occupant sitting in the chair, the seat 14 (and in fact the entire seat structure 13) can tilt backwardly and downwardly about the tilt axis 19 through a limited tilt angle which generally is a minimum of about 15°. This minimum tilt is diagrammatically illustrated by dotted lines in FIG. 1.

The tilt mechanism 18 (FIG. 3) includes a housing structure 21 which is mounted on the upper end of the pedestal 16 and projects forwardly therefrom, which housing structure in turn rotatably supports thereon a support structure 22 for relative tilting about the axis 19. This support structure 22 in turn is fixedly secured to a frame (not shown) which is disposed internally of the seat 14, with the support structure 22 projecting downwardly below the bottom shell or pan which encloses the seat 14. First and second spring-type biasing means 23 and 24 coact between the housing structure 21 and the support structure 22 for imposing a biasing or restoring torque on the support structure 22, and hence on the seat 14, so as normally maintain the latter in the horizontal or zero-tilt position. A pretorque adjusting means 25 cooperates with the biasing means 23 for defining a base or initial torque which continuously acts against the support structure 22 and seat 14 so as to maintain it in its zero-tilt position.

Figure 3:
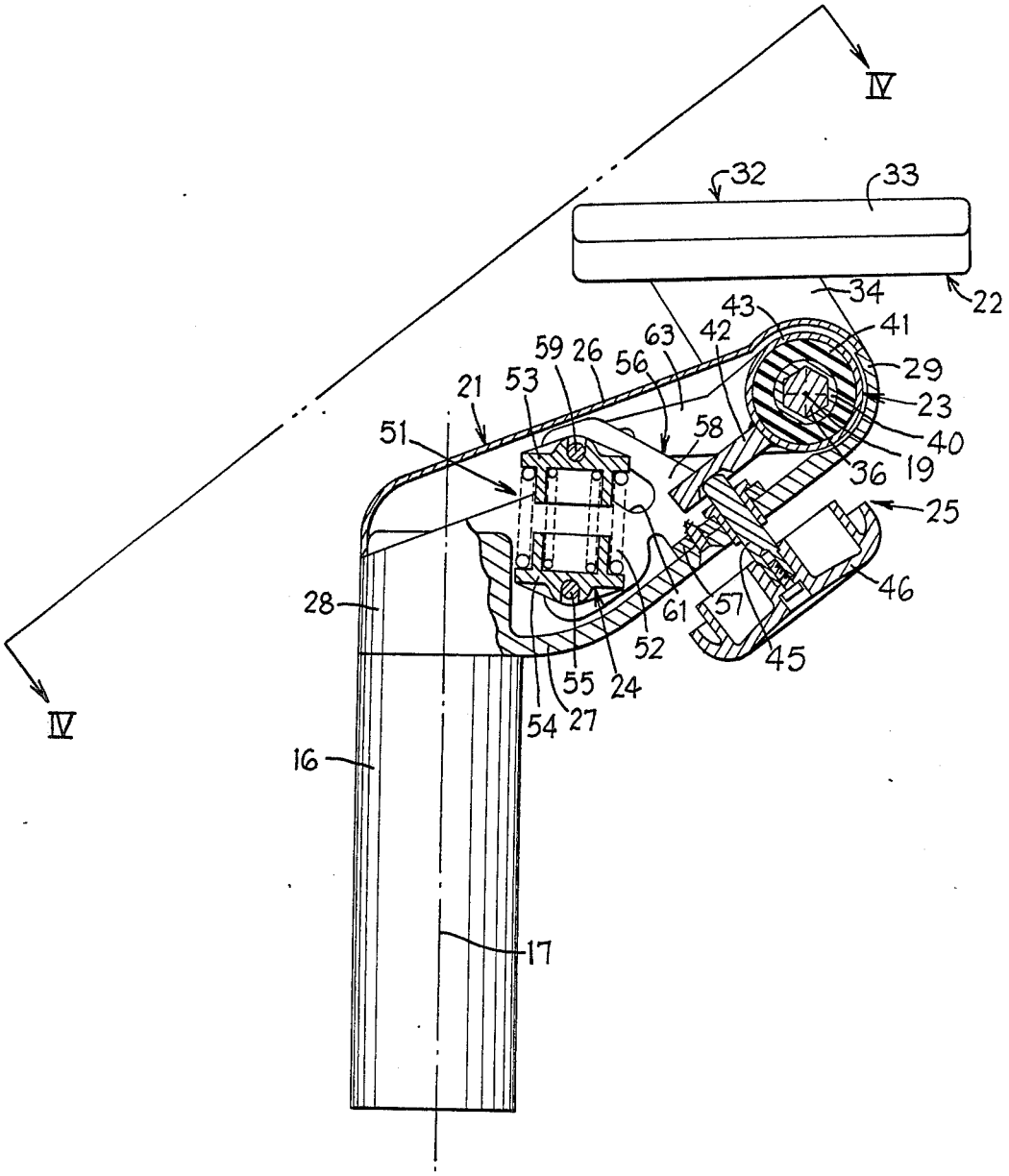
FIG. 3 is a side elevational view of the knee-tilt control mechanism, partially in cross section, as taken substantially along line III—III in FIG. 4.
Figure 4:
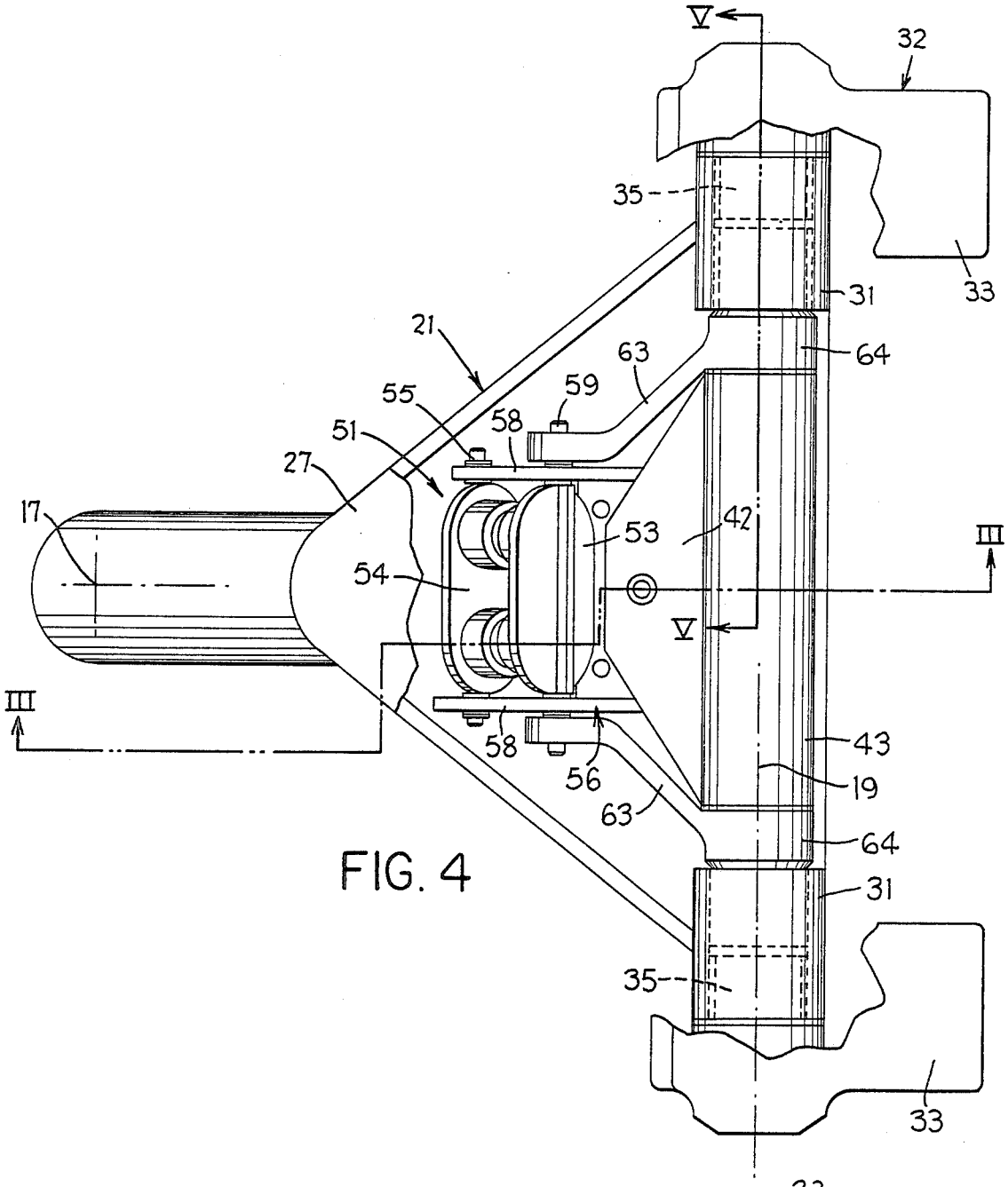
FIG. 4 is a fragmentary view as taken substantially along line IV—IV in FIG. 3.
Figure 5:
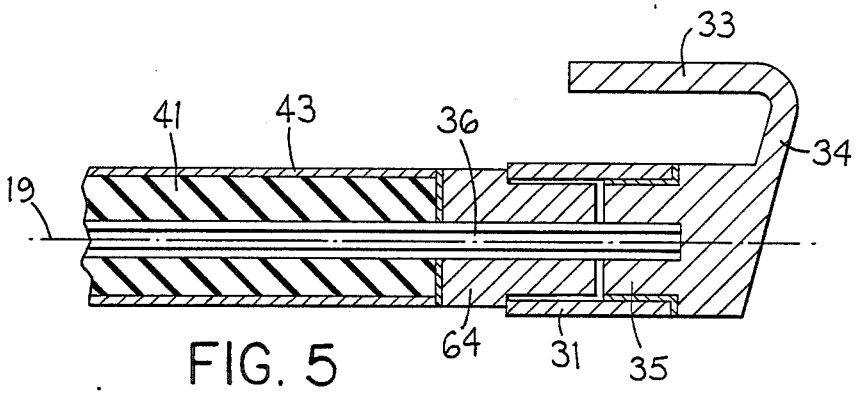
FIG. 5 is a fragmentary sectional view as taken substantially along line V—V in FIG. 4.

Considering now the details of the tilt mechanism 18 as shown by FIGS. 3–5, the housing structure 21 includes top and bottom cover plates 26 and 27 which are approximately of triangular shape and are rigidly joined together at their apex so as to define a hub 28, the latter being telescoped over the upper end of the pedestal 16. The housing 21 projects forwardly from this hub 28 toward the front free edge of the seat 14, and the forward edges of the plates 26–27 are rigidly joined to a horizontally elongated front wall 29 which extends transversely relative to the seat slightly therebelow and spaced inwardly a small distance from the front edge thereof. This front wall 29 extends between and is rigidly joined to a pair of sidewardly spaced sleevelike hubs or tubes 31. These tubes 31 are axially aligned and define the tilt axis 19.

The support structure 22 is pivotally or hingedly supported on the housing structure 21, and for this purpose includes a pair of mounting brackets 32 which have parallel upper plate portions 33 which are sidewardly spaced apart and disposed within the interior of the seat 14, these plate portions 33 being rigidly secured to the interior frame (not shown) of the seat. The plate portions 33 extend approximately horizontally when in the zero-tilt position, and at their outer edges are provided with downwardly projecting arms 34, the latter terminating in inwardly opposed and coaxially aligned cylindrical hubs 35 which are rotatably received within the ends of the tubes 31. The hubs 35 are nonrotatably fixed to opposite ends of a shaft 36 which extends through tubes 31 along the axis 19.

Considering now the first biasing means 23, it includes a spring 41, the latter preferably comprising a torsion spring formed of an elastomeric or rubberlike material. This torsion spring 41 is formed substantially as an axially elongated hollow tube or sleeve disposed in surrounding relationship to and nonrotatably secured, as by bonding, to a metal sleeve 40. This sleeve 40 has a hole extending axially therethrough, which hole is of a noncircular (i.e., hexagonal) cross section in the preferred embodiment and snugly accommodates therein the metal shaft 36 which is also of hexagonal cross section so as to be nonrotatably coupled to the sleeve 40. The sleeve spring 41 is also nonrotatably coupled to a radially outwardly projecting lever 42. This lever 42 has, at its inner end, a sleevelike hub 43 which surrounds the elastomeric spring 41 and is nonrotatably coupled to the outer peripheral wall thereof.

The lever 42 is normally maintained in a stationary position relative to the housing structure 21, and for this purpose the lever 42 adjacent its outer end cooperates with the pretorque adjusting means 25. The latter includes an adjusting shaft 45 which is threadably rotatably supported on the bottom wall 27 so as to project outwardly therebelow. A knob 46 is nonrotatably secured to the outer or lower end of this threaded adjusting shaft 45. The inner or upper end of this shaft 46 abuts the underside of the lever 42 so as to normally maintain the latter in a stationary position relative to the housing structure 21. When the chair seat is tilted backwardly away from its zero-tilt position, the shaft 36 rotates counterclockwise in FIG. 3 so as to torque the elastomeric spring sleeve 41 inasmuch as the lever 42 and sleeve 43 hold the outer periphery of the elastomeric spring 41 stationary. The torque generated by the sleeve spring 41 hence increases approximately linearly substantially as illustrated by the torque $T_1$ as graphed in FIG. 8. The initial or pretorque $T_0$ of this spring 41 can be adjusted by rotating the knob 46 and shaft 45 so as to move the latter upwardly, and hence lift the lever 42 upwardly (clockwise in FIG. 3). This causes the spring sleeve 41 to be pretorqued in the direction opposite to that caused when the chair seat is tilted, and thus increases the restoring torque $T_0$ which exists at the zero-tilt position.

The use of an elastomeric sleevelike torsion spring, oftentimes referred to as a "rubber pack", is well known and it will be appreciated that the torque developed by the elastomeric spring 41 in response to increased angular distortion thereof will not necessarily follow a perfect linear relationship in view of the fact that such characteristic can vary due to the specific properties of the elastomeric material.

Considering now the second biasing means 24, it includes a spring unit 51 which is defined by a pair of conventional coil-type compression springs 52 disposed in parallel, which compression springs are confined between relatively movable upper and lower retainers 53 and 54, respectively. Each of the compression springs 52 preferably comprises, in the illustrated embodiment, concentric inner and outer coil springs so as to increase the spring force capacity. The lower retainer is secured to a lower transversely extending hinge pin 55 which is pivotally supported on a bracket 56.

The bracket 56 is disposed within the housing structure 21 between the upper and lower plates thereof, and is of a generally U-shaped or channel-shaped configuration in that it includes a bight plate 57 having a pair of substantially parallel side plates or arms 58 projecting upwardly from opposite ends thereof. The bight 57 overlies and is suitably fixedly secured to the bottom plate 27.

The lower pivot pin 55 as associated with the lower retainer 54 has the opposite ends thereof suitably pivotally supported on the side plates 58, whereby the lower pivot pin 55 hence defines a pivot axis which extends generally parallel with the tilt axis 19.

Figure 6:
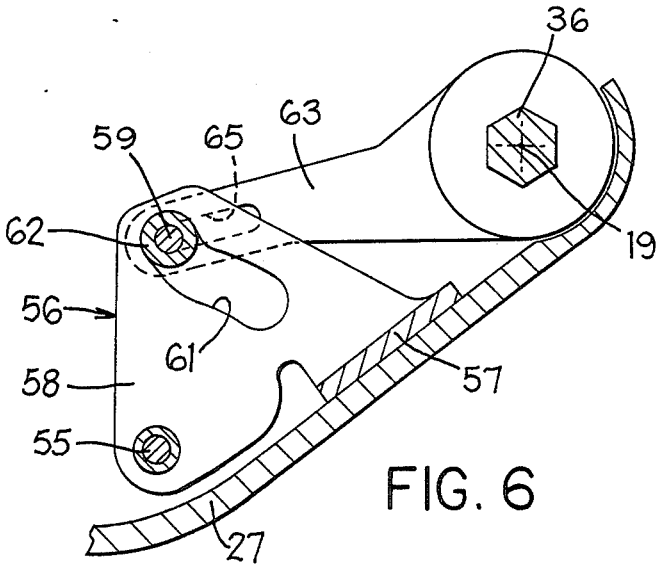
FIG. 6 is a sectional view, on an enlarged scale, illustrating the relationship of the nonlinear restoring mechanism, the spring being removed for clarity of illustration.

The upper retainer 53 also has a pivot pin 59 mounted thereto and extending transversely thereof, this pin 59 being generally parallel with the lower pin 55. The upper pivot pin 59 extends transversely between and through the side plates 58, and for this purpose the side plates 58 have identical cam slots 61 formed therein and through which pass the outer ends of the upper pivot pin 59. The pivot pin 59 has suitable rollers 62 (FIG. 6) thereon which are confined and rollingly engaged within the cam slots 61.

The second biasing means 24 also includes a pair of levers 63 which cooperate with the spring unit 51 for controlling the position and compression thereof. These levers 63 project radially outwardly from the tilt axis 19 in generally parallel relationship. The levers 63, at their radially inner ends, are provided with support hubs 64 which are nonrotatably secured to the shaft 36 and are loosely rotatably positioned within the tubes 31. These hubs 64 are disposed adjacent opposite ends of, and hence straddle, the elastomeric sleeve spring 41. The levers 63 as they project radially outwardly from the hubs 64 are also disposed so as to straddle the bracket 56, with each lever 63 being disposed closely adjacent an outer side surface of one of the side plates 58. Each of these levers 63 has a cam slot 65 (FIG. 6) formed therein adjacent the free end thereof, and this cam slot 65 movably confines therein the outer end of the upper pivot shaft 59. The end of shaft 59 preferably has a cam roller thereon confined for rolling engagement within the slot 65.

Figure 7:
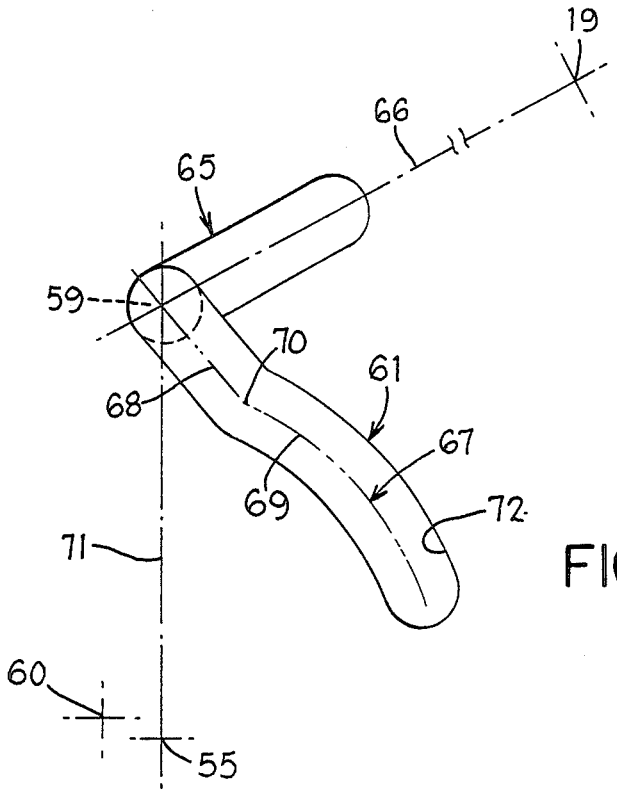
FIG. 7 illustrates, on an enlarged scale, the cooperating cam profiles.

The cam slot 65 has a profile which, as indicated by the line 66 in FIG. 7, extends generally radially of the lever 63 relative to the tilt axis 19.

Considering now the profile of the cam slot 61, this has a profile which is nonlinear as indicated by the dash-double dot line 67. This profile 67 includes a first substantially linear profile 68 which extends from the zero-tilt position to an intermediate position which is a tilt of approximately 5°, at which intermediate position there is then defined a second profile 69 which extends to the full tilt angle which is a maximum of about 15° to 26°. The first and second profile portions 68 and 69 are joined together through a smooth transition curve.

The second profile portion 69 preferably has a nonlinear relationship and, in the illustrated embodiment, is defined by an arc generated substantially about an axis 60 which is parallel to but spaced sidewardly from the axis of the lower pivot pin 55. In fact, the axis 60 and the axis of pivot pin 55 are both preferably spaced equally from the uppermost end of the profile portion 69, which uppermost end is graphically defined by the point 70 in FIG. 7. Since profile portion 69 is generated about axis 60 in a downward swinging direction away from the point 70, this hence causes the profile portion 69 to continuously and progressively move closer to the axis 55 as the profile portion 69 is generated downwardly toward its free or lower end. The axis 60 and the profile portion 69 are disposed on opposite sides of an imaginary vertical plane 71 which extends through and contains the axes of the pivot pins 55 and 59 when the pivot pin 59 is disposed in the upper end of the profile portion 68 corresponding to the zero-tilt position.

The first profile portion 68 extends transversely relative to the radial direction 70 between the upper and lower pivot pins 55 and 59 respectively, and this first profile portion 68 also extends transversely relative to the radial direction (as represented by the line 66) of the lever 63. In fact, in the range of movement of lever 63 between the zero-tilt position and its intermediate position (of substantially 5° tilt), the first profile 68 very nearly perpendicularly intersects the profile 66.

When the chair seat 14 is in its zero-tilt position, the second biasing means 24 occupies the position substantially as illustrated in the drawings, and hence the spring unit 51 is subject to some initial compression so that this acts against the levers 63 so as to exert an initial or pretorque $T_0'$ for assisting in maintaining the chair seat in its zero-tilt position. As the chair seat is tilted from its zero-tilt position to an intermediate tilt position of approximately 5°, this causes the cam levers 63 to rotate downwardly (counterclockwise) forcing the upper pivot pin 59 to slide downwardly along the upper cam profile 68 of the slot 61, and simultaneously slide radially inwardly of the cam slot 65. This hence causes the compression of the spring unit 51 to substantially linearly increase, and the torque imposed about the tilt axis 19 also substantially linearly increases approximately as diagrammatically illustrated by the dash-dot line $T_2$ in FIG. 8. Upon reaching the intermediate position, however, further downward tilt of the chair and of the levers 63 causes the upper pivot pin 59 to pass through the transition into the upper end of the second profile 69. Since profile 69 is effectively generated about the lower pivot 55, this effectively results in the force of the spring pack 51 being effectively confined by the bracket 56, and hence the spring force exerted on the levers 63 decreases significantly, thereby also causing the restoring torque as generated by this second biasing means 24 to significantly decrease throughout the remaining angle of tilt as diagrammatically illustrated by FIG. 8.

Figure 8:
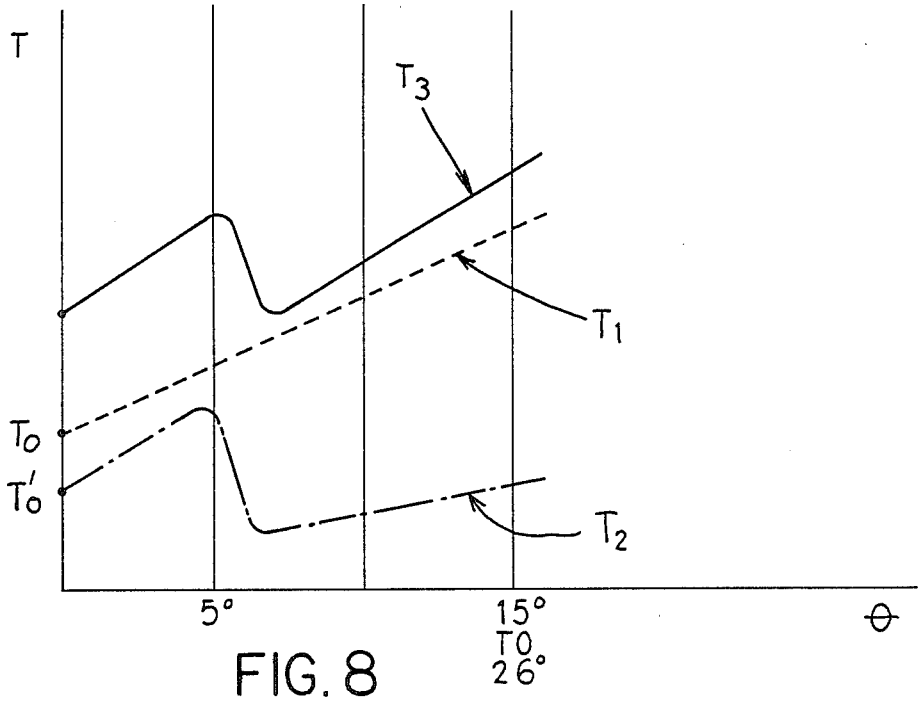
FIG. 8 diagramatically illustrates the relationship between torque and tilt angle associated with the mechanism of FIGS. 3–7.

Since the restoring torque imposed on the chair seat is the sum of the torques generated by the first and second biasing means 23 and 24 respectively, this total torque hence effectively has a pattern which is diagrammatically approximated by the solid line $T_3$ in FIG. 8. That is, the torque will initially increase at a substantially steep and approximately linear rate as the chair seat tilts away from the zero-tilt position, and hence this will enable the chair seat to move into a position of about 2° to about 3°, which position is optimum for normal support of the occupant's weight. Further, the tilt torque will continue to increase significantly so that the occupant can tilt the chair back to an angle of about 5°, at which time the restoring torque no longer increases significantly at this intermediate location, but rather undergoes a dwell or slight decrease, following which the restoring torque will then again thereafter increase (but at a lesser rate) until reaching the maximum tilt position. In this manner, after passing through this intermediate "dwell" location, the occupant will again feel an increase in restoring torque as he tilts backward toward the full tilt position, but at the same time the restoring torque which the occupant must overcome is of such magnitude as to permit the occupant to tilt the chair to the full tilt position without causing the tilting operation to be uncomfortable or stressful.

While the embodiment described above utilizes the cam slot 61 for controlling movement of the upper hinge pin 59 and corresponding movement of the lever 63, it will be appreciated that in actuality it is the upper edge 72 of the cam slot 61 which effectively controls movement of the upper pivot pin 59. This upper edge 72 defines the cam profile which controls the movement of the upper pivot pin 59, and hence controls the movement of the lever 63. Use of the closed slot 61 is preferred, however, so as to provide positive control over the pin 59 in all positions of use.

Figure 9:
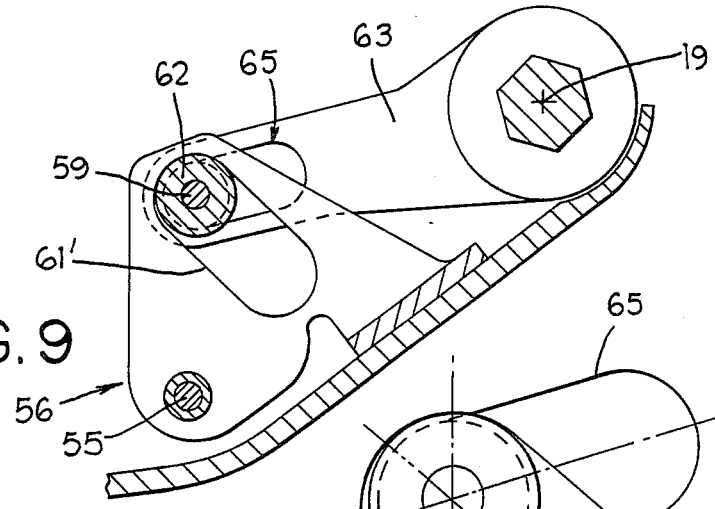
FIGS. 9–11 are views which respectively correspond to FIGS. 6–8 but illustrate a preferred variation of the invention.
Figure 10:
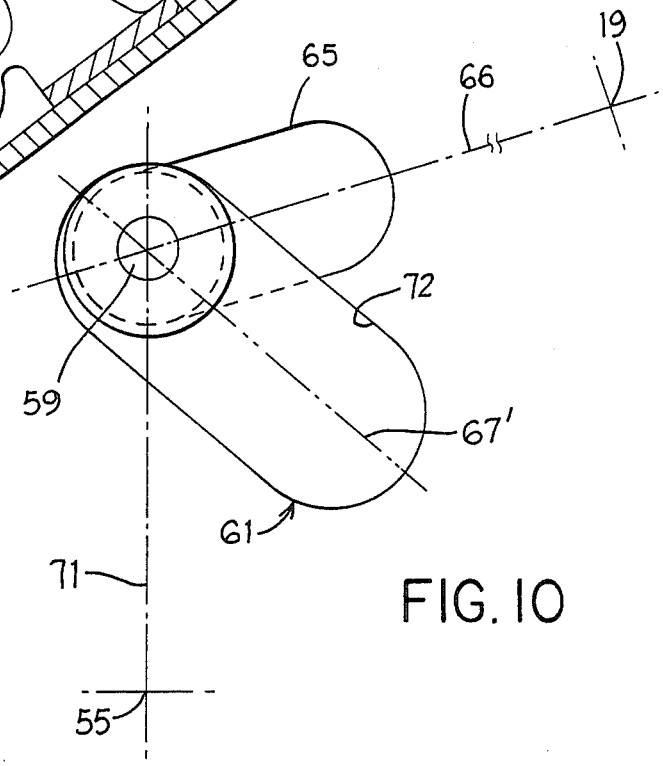
Figure 11:
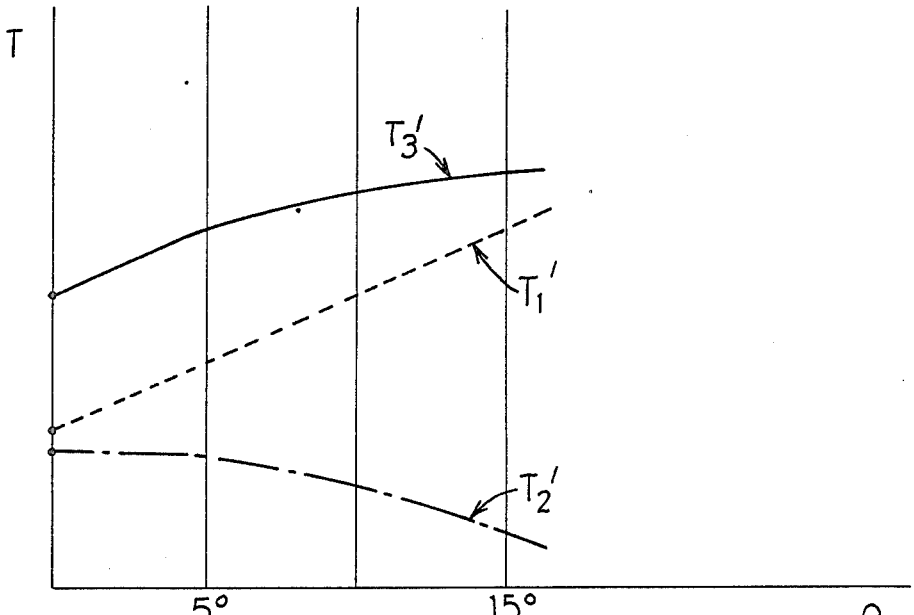

Referring now to FIGS. 9–11, there is illustrated a preferred variation of the present invention wherein corresponding parts are designated by the same reference numerals utilized above, except that the reference numerals utilized to illustrate parts which have been modified additionally have a prime (') used in conjunction therewith so as to distinguish the modified parts from those parts which have been described above.

According to the modifications shown by FIGS. 9–11 (which figures respectively correspond to FIGS. 6–8 above), the cam slot 61' as formed in the bracket 56 has a profile which is linear throughout its length as indicated by the dash-double dot line 67'. This linear profile 67' extends from the zero-tilt position as represented by the position of the upper pivot pin 59 in FIGS. 9 and 10, through the intermediate position to the full tilt angle. The profile 67' extends in transverse relationship to the radial direction 66 of the lever slot 65, and also extends in transverse relation to the plane 71 when the upper pivot pin 59 is in the zero-tilt position. These transverse relationships are preferably non-perpendicular with respect to the line 66 and plane 71, and in fact in the preferred embodiment the profile 67' approximately bisects the angle defined between the line 66 and plane 71 when in the zero-tilt position. It is also essential that the radial line 61 and the plane 71, when in the zero-tilt position, themselves extend in transverse intersecting relationship to one another, which relationship defines an included angle therebetween in the range of about 120° to about 135°.

In this embodiment of FIGS. 9–11, the upper edge 72 is the cam profile which controls the upper pivot pin 59, and thus provision of the closed slot 61' is solely for purposes of convenience to optimize control of the pin 59 under all conditions of use.

With this embodiment of FIGS. 9–11, the overall tilt mechanism works in a very similar manner to that described above. More specifically, the restoring torque follows a pattern which is diagrammatically illustrated by FIG. 11. That is, the torque $T_1'$ designates the linearly increasing restoring torque generated by the main spring unit 23 as the chair seat tilts backwardly through its full tilt angle. On the other hand, according to the embodiment of FIGS. 9–11, the secondary biasing means 24 generates a torque having a pattern which more closely resembles that illustrated by the dash-dot line $T_2'$ as appearing in FIG. 11. This restoring torque $T_2'$ starts at an initial pretorque corresponding to the zero-tilt position, and the restoring torque $T_2'$ remains fairly constant or uniform at this initial pretorque level throughout the initial chair tilt up to about 4° or 5°. Thereafter the restoring torque $T_2'$ progressively and continuously decreases throughout the remainder of the full tilt angle, and in fact the restoring torque $T_2'$ deceases at an increasing rate as the chair seat approaches the full tilt angle. Hence, the combined restoring torque $T_3'$ which is imposed on the chair seat is thus the sum of the torques $T_1'$ and $T_2'$. This restoring torque $T_3'$ starts with the pretorque at the zero-tilt position, and thereafter increases fairly linearly up to the intermediate position of about 5° , and from that point on the restoring torque $T_3$, continues to increase throughout the full angle of tilt, but continues to increase at a decreasing rate so that the total restoring torque $T_3'$ at the full tilt angle exhibits a curve which tends to flatten out. Thus, the overall effect is to provide a restoring torque which can have an initial pretorque of a magnitude sufficient to prevent excessive tilt of the chair seat under the normal occupant weight, which will still have a fairly linearly and desirably increasing restoring torque up to about the 5° position so as to permit normal use of the chair without encountering excessive tilt, and which will also permit the chair to be readily tilted throughout its full tilt angle while at the same time generating a restoring torque which continuously increases throughout the full tilt angle but does so at such a rate as to permit full tilt to be readily and comfortably accomplished by the chair occupant.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a pedestal-type chair having a base assembly defining thereon a pedestal which projects vertically upwardly in cantilevered fashion, a seat structure having both a seat and a back, the seat being disposed directly above the pedestal so that the latter has its vertical centerline intersecting the seat adjacent the midpoint thereof, and a knee-tilt mechanism connected between the pedestal and seat and defining a substantially horizontally extending tilt axis which extends sidewardly relative to the seat in the vicinity of the front edge thereof for permitting the seat to be tilted downwardly about the tilt axis from a substantially zero-tilt position when the chair is unoccupied through a maximum tilt angle to a lower tilt position when the chair is occupied, said tilt axis being disposed a substantial distance forwardly from and in nonintersecting relationship to the vertical centerline of said pedestal, the improvement wherein said tilt mechanism comprises:

a housing structure mounted on said pedestal adjacent the upper end thereof and projecting forwardly therefrom toward the front edge of said seat, and a support structure secured to said seat and projecting downwardly therefrom adjacent but spaced slightly rearwardly from the front edge thereof, said support and housing structures having opposed parts which are relatively rotatably supported on one another for defining said tilt axis;

first biasing means coacting between said housing and support structures for imposing a restoring torque about said tilt axis which normally urges said seat into said zero-tilt position, said first biasing means including spring means for generating a restoring torque which increases approximately linearly in relationship to the angularity of seat tilt as the seat tilts from the zero-tilt position toward the lower tilt position;

second biasing means coacting between said support and housing structures for imposing a restoring torque about said tilt axis which continuously urges said seat toward said zero-tilt position, said second biasing means being operatively coupled between said structures in generally parallel relationship with said first biasing means so that said first and second restoring torques add together for urging the seat toward said zero-tilt position;

said second biasing means including a spring unit hingedly supported at one end about a first substantially horizontal pivot axis and lever means hingedly supported at one end about a second substantially horizontal pivot axis which is parallel with but spaced sidewardly from said first pivot axis, one of said first and second pivot axes being coaxially aligned with said tilt axis, and cam means cooperating between the other end of said spring unit and the other end of said lever means for creating said second restoring torque, said cam means including cam follower means associated with the other end of said spring unit, said cam means also including a first elongated cam profile associated with the other end of said lever means and a second elongated cam profile stationarily associated relative to one of said structures, said cam follower means being cooperatively engaged with and captivated between said first and second elongated cam profiles.

2. A chair according to claim 1, wherein said first spring means comprises a sleevelike torsion spring member constructed of a rubberlike elastomeric material.

3. A chair according to claim 2, wherein said sleevelike spring member surrounds and is nonrotatably coupled to a shaft which is fixed to said support structure, said shaft extending along said tilt axis, and pretorque adjusting means coupled between said housing structure and an exterior wall of said sleeve-like spring member for permitting the pretorque on said sleevelike spring member when the chair is in said zero-tilt position to be selectively adjusted.

4. A chair according to claim 3, wherein said lever means has the one end thereof nonrotatably coupled to said support structure for angular displacement about said tilt axis, said first cam profile extending approximately radially of said lever means adjacent the other end thereof, said spring unit being disposed so that its line of force extends at a substantial angle to and in intersecting relationship with the radially extending direction of said lever means when the seat is in said zero-tilt position, said second cam profile extending transversely with respect to the radial direction of said lever means and also with respect to the line of force of said spring unit.

5. A chair according to claim 4, wherein a bracket structure is fixedly secured to said housing structure and includes a pair of spaced and substantially parallel sidewalls which confine said spring unit therebetween, said spring unit having a first pin at said one end thereof, said first pin extending transversely between and supported on said spaced sidewalls for defining said first pivot axis, said sidewalls having a pair of second cam slots formed therein and defining said second cam profiles, said lever means including a pair of sidewardly spaced levers disposed respectively adjacent said sidewalls, said last-mentioned levers having a pair of first cam slots formed therein and defining said first cam profiles, and said spring unit having a second pin associated with the other end thereof and extending transversely between said sidewalls so that opposite ends of said second pin project through and are captivated by the respectively adjacent pairs of first and second cam slots.

6. A chair according to claim 5, wherein said second cam profile as defined by said second cam slot includes (1) a first profile portion which is substantially linear for causing substantially linear compression of said spring unit as the seat tilts from the zero-tilt position to said intermediate position and (2) a second profile portion which merges smoothly with said first profile portion and controls compression of said spring unit as the chair tilts from said intermediate position to said lower tilt position, said second profile portion being generated on a radius having its center located in close proximity to said first pivot axis.

7. A chair according to claim 1, wherein said lever means has the one end thereof nonrotatably coupled to said support structure for angular displacement about said tilt axis, said first cam profile extending approximately radially of said lever means adjacent the other end thereof, said spring unit being disposed so that its line of force extends at a substantial angle to and in intersecting relationship with the radially extending direction of said lever means when the seat is in said zero-tilt position, said second cam profile extending transversely with respect to the radial direction of said lever means and also with respect to the line of force of said spring unit.

8. In a pedestal-type chair having a base assembly defining thereon a pedestal which projects vertically upwardly in cantilevered fashion, a seat structure having both a seat and a back, the seat being disposed directly above the pedestal so that the latter has its vertical centerline intersecting the seat adjacent the midpoint thereof, and a knee-tilt mechanism connected between the pedestal and seat and defining a substantially horizontally extending tilt axis which extends sidewardly relative to the seat in the vicinity of the front edge thereof for permitting the seat to be tilted downwardly about the tilt axis from a substantially zero-tilt position when the chair is unoccupied through a maximum tilt angle to a lower tilt position when the chair is occupied, said tilt axis being disposed a substantial distance forwardly from and in nonintersecting relationship to the vertical centerline of said pedestal, the improvement wherein said tilt mechanism comprises:

a housing structure mounted adjacent the upper end of said pedestal and projecting forwardly therefrom toward the front edge of said seat, said housing structure being substantially closed and defining therein an interior compartment disposed between upper and lower housing walls;

a support structure secured to said seat and projecting downwardly therefrom adjacent but spaced slightly rearwardly from the front edge thereof, said support structure having a hinge part which is pivotally supported on said housing structure and defines said tilt axis;

elongated lever means disposed within said compartment and having one end thereof nonrotatably coupled to said hinge part so that said lever means is pivotal about said tilt axis;

biasing means coacting between said housing structure and said lever means for imposing a restoring force on said lever means and hence a restoring torque about said tilt axis which urges said seat toward said zero-tilt position, said biasing means cooperating with said lever means so as to create a restoring torque which increases approximately linearly as the seat tilts from the zero-tilt position to an intermediate position but which deviates from and is significantly less than the restoring torque which would be created by extension of said linear relationship as the chair seat tilts from said intermediate position to said lower tilt position;

said biasing means including bracket means secured to said housing structure and defining a substantially upright wall, and a compression-type spring means coacting between said lever means and said housing structure for normally exerting a force against said lever means tending to urge the latter towards said zero-tilt position, said spring means having one end thereof remote from said lever means supported for pivotal movement about a first generally horizontal pivot axis which is parallel with said tilt axis and stationarily related relative to said housing structure;

said biasing means also including cam means coacting between said lever means, said spring means and said support bracket for regulating the restoring torque in response to the seat tilt, said cam means including first and second elongated cam profiles respectively and stationarily associated with the lever means and the support bracket, and a cam follower associated with the other end of said spring means and cooperatively engaged and captivated between said first and second cam profiles.

9. In a pedestal-type chair having a base assembly defining thereon a pedestal which projects vertically upwardly in cantilevered fashion, a seat structure having both a seat and a back, the seat being disposed directly above the pedestal so that the latter has its vertical centerline intersecting the seat adjacent the midpoint thereof, and a knee-tilt mechanism connected between the pedestal and seat and defining a substantially horizontally extending tilt axis which extends sidewardly relative to the seat in the vicinity of the front edge thereof for permitting the seat to be tilted downwardly about the tilt axis from a substantially zero-tilt position when the chair is unoccupied through a maximum tilt angle to a lower tilt position when the chair is occupied, said tilt axis being disposed a substantial distance forwardly from and in nonintersecting relationship to the vertical centerline of said pedestal, the improvement wherein said tilt mechanism comprises:

a housing structure mounted on said pedestal adjacent the upper end thereof and projecting forwardly therefrom toward the front edge of said seat, and a support structure secured to said seat and projecting downwardly therefrom adjacent but spaced slightly rearwardly from the front edge thereof, said support and housing structures having opposed parts which are relatively rotatably supported on one another for defining said tilt axis;

first biasing means coacting between said hopusing and support structures for imposing a first restoring torque about said tilt axis which urges said seat toward said zero-tilt position, said first biasing means defining a first torque-displacement characteristic wherein the restoring torque increases approximately lineraly as the seat tilts from the zero-tilt position into the lower tilt position;

second biasing means coacting between said support and housing structures for imposing a second restoring torque about said tilt axis which urges said seat toward said zero-tilt position, said second biasing means defining a second torque-displacement characteristic wherein restoring torque decreases as the seat tilts from the zero-tilt position into the lower tilt position; and said first and second torque-displacement characteristics and the torque generated thereby being additive as the seat is tilted away from the zero-tilt position so as to definje a cumulative restoring torque which increases as the seat is tilted toward the lower tilt position.

10. A chair according to claim 9, wherein the first and second biasing means respectively include first and second spring means which are connected between said support and housing structures in parallel relationship with respect to one another.

11. In a pedestal-type chair having a base assembly defining thereon a pedestal which projects vertically upwardly in cantilevered fashion, a seat structure having both a seat and a back, the seat being disposed directly above the pedestal so that the latter has its vertical centerline intersecting the seat adjacent the midpoint thereof, and a knee-tilt mechanism connected between the pedestal and seat and defining a substantially horizontally extending tilt axis which extends sidewardly relative to the seat in the vicinity of the front edge thereof for permitting the seat to be tilted downwardly about the tilt axis from a substantially zero-tilt position when the chair is unoccupied through a maximum tilt angle to a lower tilt position when the chair is occupied, said tilt axis being disposed a substantial distance forwardly from and in nonintersecting relationship to the vertical centerline of said pedestal, the improvement wherein said tilt mechanism comprises:

a housing structure mounted on said pedestal adjacent the upper end thereof and projecting forwardly therefrom toward the front edge of said seat, and a support structure secured to said seat and projecting downwardly therefrom adjacent but spaced slightly rearwardly from the front edge thereof, said support and housing structures having opposed parts which are relatively rotatably supported on one another for defining said tilt axis; and torque restoring means coacting between said housing and support structures for imposing a restoring torque about said tilt axis which urges said seat toward said zero-tilt position, said torque restoring means including:

first means fixed relative to said support structure and defining thereon a first elongate cam surface which extends generally rearwardly of said seat away from said tilt axis, second means fixed relative to said housing structure and defining thereon a second elongate cam surface which extends in transverse and intersecting relationship relative to said first elongate cam surface, cam follower means confined between and movable along said first and second elongate cam surfaces, and spring means continuously urging said cam follower means into continuous engagement with both of said first and second elongate cam surfaces and for imposing a restoring torque on said seat which continuously urges it toward said zero-tilt position, said spring means having one end thereof anchored to said cam follower means and the other end thereof anchored to said support structure, said other end being anchored to said support structure at a location which is disposed rearwardly from said tilt axis.

12. A chair according to claim 11, wherein said first means comprises an elongate lever which is fixed to said support structure and is pivotally supported relative to said housing structure for vertical pivoting movement about said tilt axis, said first elongate cam surface extending longitudinally of said lever in a direction which is generally radial with respect to said tilt axis, said second elongate cam surface being elongated in a direction which extends transversely with respect to both said first elongate cam surface and the line of force generated by said spring means.

13. In a pedestal-type chair having a base assembly defining thereon a pedestal which projects vertically upwardly in cantilevered fashion, a seat structure having both a seat and a back, the seat being disposed directly above the pedestal so that the latter has its vertical centerline intersecting the seat adjacent the midpoint thereof, and a knee-tilt mechanism connected between the pedestal and seat and defining a substantially horizontally extending tilt axis which extends sidewardly relative to the seat in the vicinity of the front edge thereof for permitting the seat to be tilted downwardly about the tilt axis from a substantially zero-tilt position when the chair is unoccupied through a maximum tilt angle to a lower tilt position when the chair is occupied, said tilt axis being disposed a substantial distance forwardly from and in nonintersecting relationship to the vertical centerline of said pedestal, the improvement wherein said tilt mechanism comprises:

a housing structure mounted on said pedestal adjacent the upper end thereof and projecting forwardly therefrom toward the front edge of said seat, and a support structure secured to said seat and projecting downwardly therefrom adjacent but spaced slightly rearwardly from the front edge thereof, said support and housing structures having opposed parts which are relatively rotatably supported on one another for defining said tilt axis; and biasing means coacting between said housing and support structures for imposing a restoring torque about said tilt axis which continuously urges said seat toward said zero-tilt position, said biasing means defining a non-linear torque-displacement characteristic as the seat tilts from the zero-tilt position into the lower tilt position, said biasing means including:

an elongate lever fixed to one of said structures and supported adjacent one end thereof for pivoting movement relative to the other said structures about said tilt axis, said lever defining thereon a first elongate reaction surface, cam means fixed relative to said other structure and defining thereon a second elongate reaction surface which extends in generally intersecting relationship relative to said first reaction surface, follower means captively engaged between and movable along said first and second reaction surfaces, and spring means engaged with said follower means for maintaining said follower means in engagement with said first and second reaction surfaces so as to maintain a restoring torque on said lever which varies in a nonlinear manner as the seat tilts away from the zero-tilt position.

14. In a pedestal-type chair having a base assembly defining thereon a pedestal which projects vertically upwardly in cantilevered fashion, a seat structure having both a seat and a back, the seat being disposed directly above the pedestal so that the latter has its vertical centerline intersecting the seat adjacent the midpoint thereof, and a knee-tilt mechanism connected between the pedestal and seat and defining a substantially horizontally extending tilt axis which extends sidewardly relative to the seat in the vicinity of the front edge thereof for permitting the seat to be tilted downwardly about the tilt axis from a substantially zero-tilt position when the chair is unoccupied through a maximum tilt angle to a lower tilt position when the chair is occupied, said tilt axis being disposed a substantial distance forwardly from and in nonintersecting relationship to the vertical centerline of said pedestal, the improvement wherein said tilt mechanism comprises:

a housing structure mounted on said pedestal adjacent the upper end thereof and projecting forwardly therefrom toward the front edge of said seat, and a support structure secured to said seat and projecting downwardly therefrom adjacent but spaced slightly rearwardly from the front edge thereof, said support and housing structures having opposed parts which are relatively rotatably supported on one another for defining said tilt axis; and biasing means coacting between said housing and support structures for imposing a restoring torque about said tilt axis which continuously urges said seat toward said zero-tilt position, said biasing means defining a non-linear torque-displacement characteristic as the seat tilts from the zero-tilt position into the lower tilt position, said biasing means including:

elongate lever means fixed to one of said structures and supported for pivotal movement about said tilt axis relative to the other said structure, follower means carried by said lever means at a location spaced radially outwardly from said tilt axis, cam means defining thereon an elongate reaction surface which is maintained in engagement with said follower means and defines a path which comes progressively closer to said tilt axis as the follower means engages said cam means and moves therealong away from the zero-tilt position, and spring means maintaining said follower means and cam means in engagement with one another for imposing a restoring torque on said lever means which increases from a minimum to a maximum along a nonlinear path so that the torque increase per degree of lever movement decreases as the lever means approaches a position corresponding to the lower tilt position of the seat.

15. A chair according to claim 5, wherein said first cam profile is of a substantially linear configuration and extends generally radially of said levers, wherein said second cam profile is substantially linear and extends in transverse and intersecting relationship relative to said first cam profile, said second cam profile also extending in transverse relationship relative to the line of force created by said spring unit, and wherein said spring unit comprises at least one coil-type spring.

16. A chair according to claim 7, wherein said spring unit includes at least one coil-type spring, and wherein said first spring means comprises a torsion-type spring which substantially surrounds said tilt axis.

17. A chair according to claim 12, including second torque restoring means coacting between said housing and support structures for imposing a restoring torque about said tilt axis which urges said seat toward said zero-tilt position, said second torque restoring means being different from and cooperating in parallel relationship with said first-mentioned torque restoring means, said second torque restoring means including torsion-type spring means coacting between said housing and said support structures for generating a torque-displacement characteristic which progressively increases as the seat is tilted away from the zero-tilt position, the torque-displacement characteristic of said second torque restoring means being significantly different from the torque-displacement characteristic of said first-mentioned torque restoring means.

18. A chair according to claim 13, including torque restoring means coacting between said housing and support structures for imposing a restoring torque about said tilt axis which continuously biases said seat toward said zero-tilt position, said torque restoring means being independent and different from said biasing means and being disposed in parallel relationship therewith so that both said biasing means and said torque restoring means impose a restoring torque about said tilt axis, said torque restoring means creating a restoring torque which varies approximately in a linear manner as the seat tilts away from the zero-tilt position.

* * * * *

UNITED STATES PATENT AND TRADEMARK OFFICE

CERTIFICATE OF CORRECTION

PATENT NO. : 4 796 950

DATED : January 10, 1989

INVENTOR(S) : Walter C. MROTZ, III et al

It is certified that error appears in the above-identified patent and that said Letters Patent is hereby corrected as shown below:

Column 14, line 20; change "hopusing" to ---housing---.
line 37; change "torque" to ---torques---.
line 39; change "definje" to ---define---.

Signed and Sealed this

Tenth Day of July, 1990

*Attest:*

*Attesting Officer*

HARRY F. MANBECK, JR.

*Commissioner of Patents and Trademarks*